US007921581B2

(12) United States Patent
Jäger

(10) Patent No.: US 7,921,581 B2
(45) Date of Patent: Apr. 12, 2011

(54) EXCAVATION DEVICE

(75) Inventor: Heinz Jäger, Volketswil (CH)

(73) Assignee: J. Muller AG, Maschineller Geleiseunterhalt, Effretikon (CH)

( * ) Notice: Subject to any disclaimer, the term of this patent is extended or adjusted under 35 U.S.C. 154(b) by 23 days.

(21) Appl. No.: 12/513,765

(22) PCT Filed: Nov. 13, 2007

(86) PCT No.: PCT/CH2007/000568
§ 371 (c)(1),
(2), (4) Date: May 6, 2009

(87) PCT Pub. No.: WO2008/061383
PCT Pub. Date: May 29, 2008

(65) Prior Publication Data

US 2010/0024256 A1 Feb. 4, 2010

(30) Foreign Application Priority Data

Nov. 23, 2006 (CH) ..... 1886/06

(51) Int. Cl.
*E02F 3/08* (2006.01)

(52) U.S. Cl. ..... 37/96; 37/190

(58) Field of Classification Search ..... 37/189, 37/190, 91–97, 347, 348, 352–359, 465; 198/518, 519, 640, 642, 509
See application file for complete search history.

(56) References Cited

U.S. PATENT DOCUMENTS

| | | | | | |
|---|---|---|---|---|---|
| 992,346 | A | * | 5/1911 | Fahey | 37/190 |
| 2,417,846 | A | * | 3/1947 | Stevens | 37/190 |
| 2,757,463 | A | * | 8/1956 | Kolbe | 37/190 |
| 2,889,043 | A | | 6/1959 | Dru | |
| 3,020,656 | A | | 2/1962 | Linden | |
| 3,390,473 | A | * | 7/1968 | Wilms et al. | 37/190 |
| 3,645,020 | A | * | 2/1972 | Beslin et al. | 37/91 |
| 4,180,927 | A | * | 1/1980 | Satterwhite | 37/190 |
| 4,234,415 | A | | 11/1980 | de Tuya Casuso | |
| 4,605,118 | A | * | 8/1986 | Kotler | 198/509 |

FOREIGN PATENT DOCUMENTS

| | | | |
|---|---|---|---|
| CH | 331 149 | A | 7/1985 |
| DE | 272 118 | C | 3/1913 |
| DE | 869 925 | C | 3/1953 |
| DE | 763 672 | C | 3/1954 |
| DE | 11 45 105 | B | 3/1963 |
| DE | 32 35 023 | A1 | 4/1983 |
| DE | 37 38 508 | A1 | 6/1989 |
| EP | 0 250 617 | A1 | 1/1988 |
| EP | 0 879 807 | A1 | 11/1998 |
| WO | 2006/074828 | A1 | 7/2006 |

* cited by examiner

*Primary Examiner* — Robert E Pezzuto
(74) *Attorney, Agent, or Firm* — Sughrue Mion, PLLC

(57) ABSTRACT

A device for excavating and transporting material, especially earth, the device comprising an excavation appliance that can be rotated about a rotational axis (y) in a rotational direction (u), and a longitudinal conveyor for transporting the excavated material. The excavation appliance comprises an impeller having a conically extending guide surface arranged around the rotational axis (y) in a rotationally symmetrical manner, and guide vanes which radially protrude from the conical guide surface and form an acute angle in relation to the rotational axis (y).

8 Claims, 5 Drawing Sheets

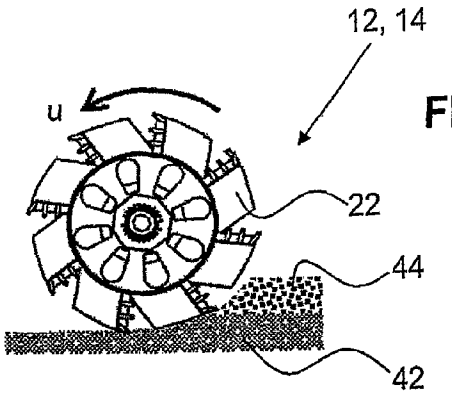
FIG. 9
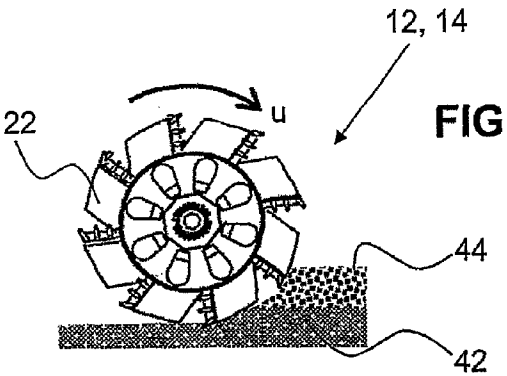
FIG. 6
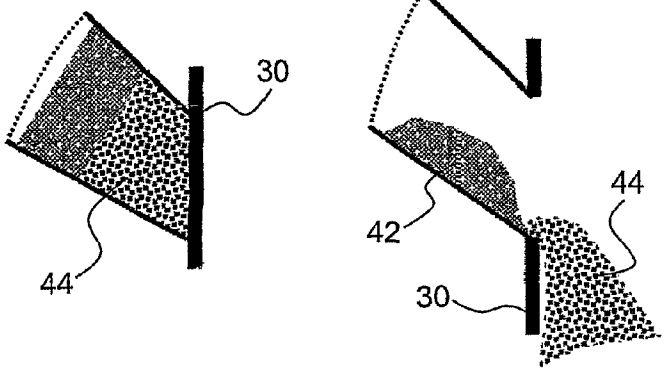
FIG. 7
FIG. 8
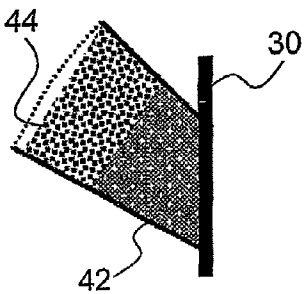
FIG. 10
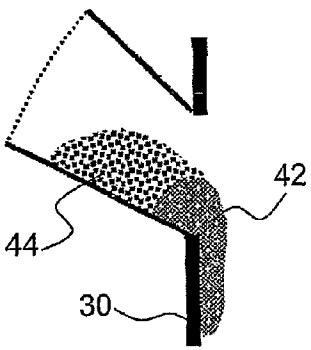
FIG. 11

EXCAVATION DEVICE

TECHNICAL FIELD OF THE INVENTION

The invention relates to an apparatus for excavating and transporting away materials, in particular soil material, with at least one excavation device which can be rotated about an axis of rotation and with a longitudinal conveyor for transporting away excavated material.

PRIOR ART

CH-A-331 149 discloses a device for excavating and loading materials that comprises downwardly directed blades which are coupled to a vibrating device and which are intended for cutting out a cross section of material enclosed by the blades.

DE-A-32 35 023 discloses an excavation apparatus with a longitudinal conveyor which is intended for transporting away loose waste, said apparatus being intended for gallery support in mining. The front end of the conveyor carries a rotating roller which is arranged transversely to the longitudinal direction of said conveyor. The roller surface is provided with breaker spikes, and a drive motor is arranged inside the roller. The driven roller takes up loose waste and simultaneously levels the floor over which the conveyor is advanced. At the same time, the waste is thrown onto the conveyor.

WO-A-2006/074828 discloses an apparatus for cleaning track ballast comprising a transverse strand of a clearing chain, said strand extending transversely with respect to a machine longitudinal direction. As the machine moves slowly forward, ballast underneath the track is dug away by means of the endlessly revolving clearing chain and passed to a cleaning unit.

SUMMARY OF THE INVENTION

The object on which the invention is based is to provide an apparatus of the type mentioned at the outset which has no exposed movable parts, such as chains or buckets, for example, and can thus have a robust design for comminuting relatively large lumps. Moreover, the excavation apparatus should be suitable for all kinds of materials to be excavated and be able to be used in the smallest spaces.

The object is achieved according to the invention in that the excavation device comprises an impeller wheel with a conically extending guide surface arranged about the axis of rotation in a rotationally symmetrical manner and with guide vanes which project radially from the conical guide surface and which form an acute angle with respect to the axis of rotation.

In a preferred embodiment, the conically extending guide surface of the impeller wheel has its narrowed end adjoining a conveyor belt and forms a run-off surface for excavated material.

Advantageously, the excavation device comprises two impeller wheels with a conveyor belt arranged between them.

The guide vanes are preferably bounded by two lateral edges which are parallel to one another, and the width of the guide vanes corresponds substantially to the width of the conically extending guide surface.

The guide vanes are preferably twisted with respect to the axis of rotation by an angle such that, as viewed in the running direction, the outer lateral edge leads the inner lateral edge.

Advantageously, the outer lateral edge of the guide vanes adjoins a fixed guide plate, at least in a region below the conveyor belt.

In one preferred embodiment, the guide plate terminates above the conveyor belt by way of an upper edge situated parallel to the conveying plane of the conveyor belt.

Advantageously, a vane covering, which covers the guide vanes, projects inwardly from a peripheral edge of the guide plate.

Preferably, the guide vanes are curved with respect to a cross section situated perpendicularly to the lateral edges, and the curved surface of the guide vanes points with its concave curvature in the direction of rotation of the impeller wheels.

Preferably, vane teeth project laterally outwardly from the guide vanes.

Advantageously, the impeller wheels are each assigned an individually controllable motor.

BRIEF DESCRIPTION OF THE DRAWING

Further advantages, features and details of the invention will become apparent from the description given below of preferred exemplary embodiments and with reference to the drawing, in which:

FIGS. 6-11 schematically show the layering of material after filling as a function of the direction of rotation;

DESCRIPTION OF EXEMPLARY EMBODIMENTS

Figure 1:
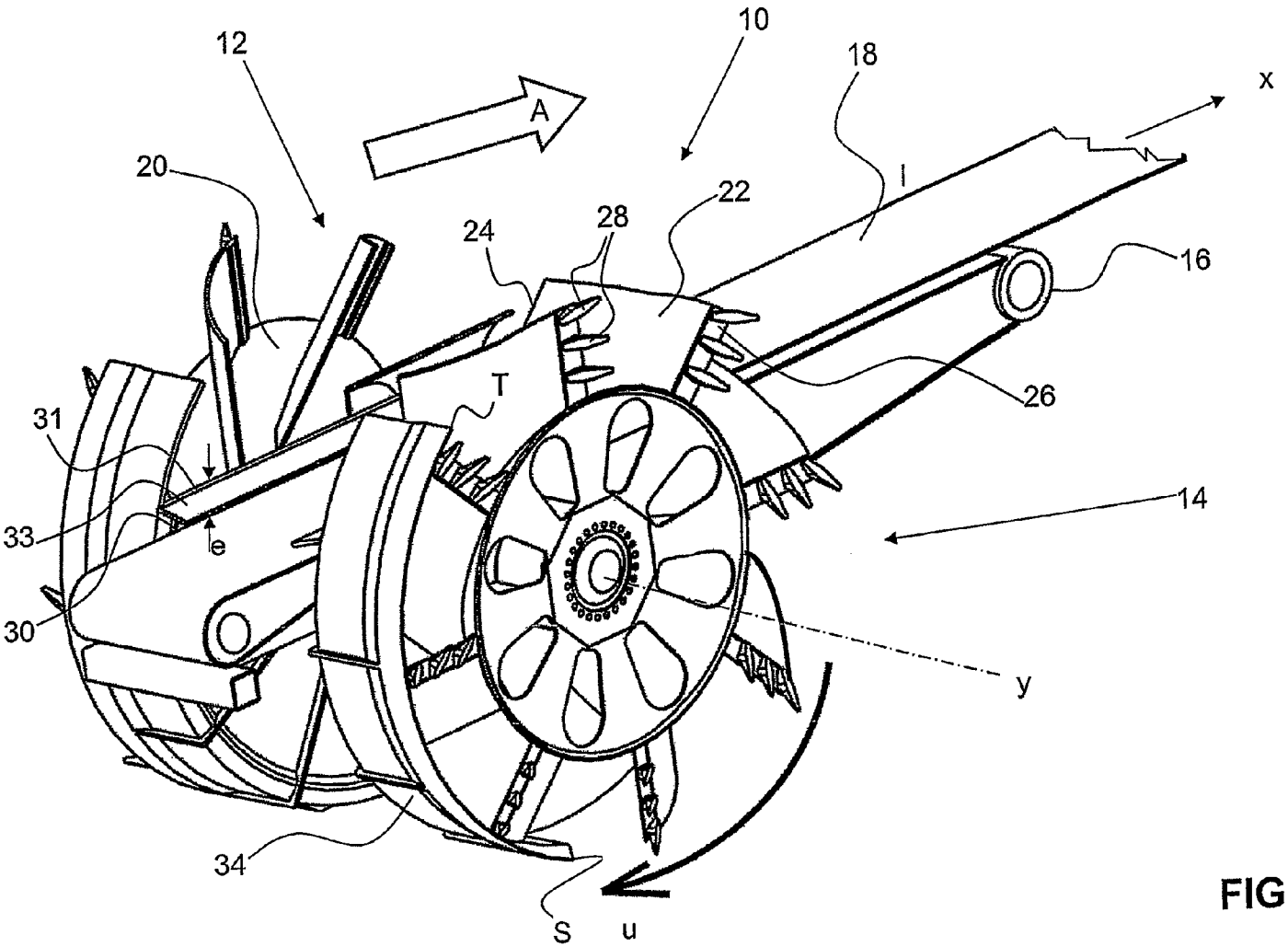
FIG. 1 schematically shows an oblique view of an excavation apparatus.

An excavation machine 10 as represented in FIG. 1 comprises two impeller wheels 12, 14 arranged concentrically and at a distance from one another. Between the impeller wheels 12, 14, which can be rotated about a common axis of rotation y, is arranged a longitudinal conveyor comprising an endlessly revolving conveyor belt 18 having a conveying direction x which is at a right angle with respect to the axis of rotation y and which generally corresponds to the operating direction A of the excavation machine 10. The impeller wheels 12, 14 and the conveyor belt 18 are mounted on a machine frame 16.

Each impeller wheel 12, 14 has a central conical guide surface 20 which is arranged in a rotationally symmetrical manner with respect to the axis of rotation y and which encloses an angle of approximately 45° with respect to said axis of rotation. Projecting outwardly from the conical guide surface 20 are guide vanes 22 which are uniformly distributed over the circumference. Here, the projection of the guide vanes 22 into the radial direction intersects the axis of rotation y at an acute angle of approximately 45°, that is to say that the surface of the guide vanes 22 is twisted by an angle of approximately 45° with respect to a radial plane emanating from the axis of rotation y. The guide vanes 22 extend over the full width of the conical guide surface 20 and are bounded by two lateral vane edges 24, 26 which are parallel to one another and at a right angle with respect to the axis of rotation y. In relation to a cross section which extends perpendicularly to the lateral edges 24, 26, the guide vanes 22 have a curved design.

The conical guide surface 20 tapers from the outer side of each impeller wheel 12, 14 toward the inner side situated adjacent to the conveyor belt 18.

The guide vanes 22 are twisted with respect to the axis of rotation y by an angle such that, as viewed in the running direction u, the outer lateral edge 26 leads the inner lateral edge 24. Here, the curved surface of the guide vanes 22 points with its concave curvature in the direction of rotation u. Vane teeth 28 project outwardly from the outer lateral edge of the guide vanes 22 and substantially tangentially from the curved surface of the guide vanes 22.

Each impeller wheel 12, 14 is covered on its inner side by a fixed guide plate 30 with a circular peripheral edge 32 as far as a region situated above the conveyor belt 18. The guide plate 30 projects by a distance e above the conveyor belt 18 by way of an edge 31 situated parallel to the conveyor belt 18. The gap between the guide plate 30 and the conveyor belt 18 in the region of the edge 31 is covered by a strip-like cover plate 33 which extends from the edge 31 to the lower-lying conveyor belt 18. In a further region between approximately the lowest point S of the impeller wheel 12, 14 and a point T above the conveyor belt 18, a vane covering 34 in the form of a band corresponding approximately to the width of the guide vanes 22 projects substantially radially outward from the peripheral edge 32 of the guide plate 30.

Figure 3:
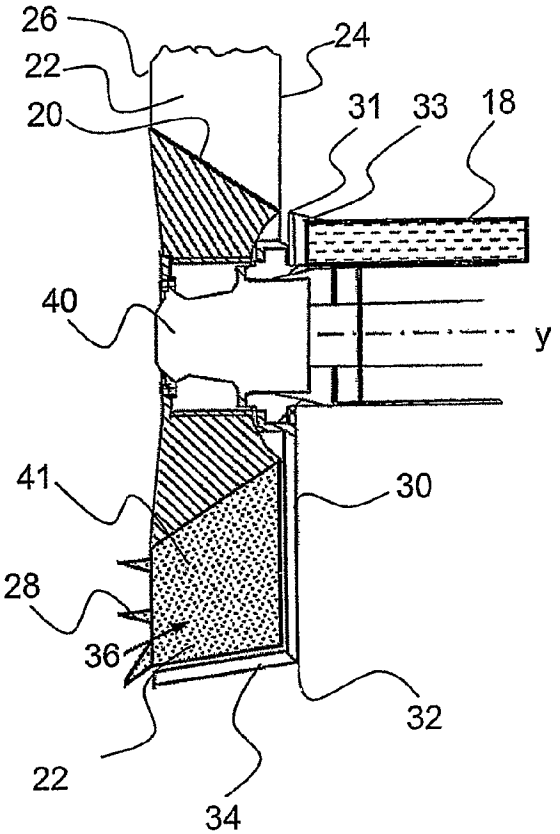
FIG. 3 schematically shows a vertical section through the axis of rotation of part of the excavation apparatus of FIG. 1 as viewed in the conveying direction.

As can be seen from FIG. 3, the guide vanes 22 guide and press excavated material 41 against the guide plate 30. The guide channel formed by the guide plate 30 and the vane covering 34 prevents the excavated material flowing out in the rising part of the impeller wheel 12, 14. In the region of this vane covering 34, between two successive guide vanes 22, is formed a chamber 36 which is defined by the guide plate and the vane covering 34 and which is open only toward the outer side of the impeller wheel 12, 14, said chamber moving in the direction of rotation of the impeller wheel 12, 14 and opening at the end of the guide plate 30 above the conveyor belt 18. The conical guide surface 20 of the chamber 36 situated above the conveyor belt 18 forms a run-off surface for the excavated material 41 on which said material can run onto the conveyor belt 18, wherein the inner peripheral edge of the conical guide surface 20 adjoins the lateral edge of the conveyor belt 18. In addition, a forced displacement of the excavated material 41 in the direction of the conveyor belt 18 is produced by the guide vane 22 situated transversely to the conveying direction x.

The two inclined planes, that is to say the orientation of the guide vanes 22 and the taper of the conical guide surface 20, jointly assist the flow of material, with the result that even bulky or viscous material such as clay can flow off in a favorable manner.

Figure 2:
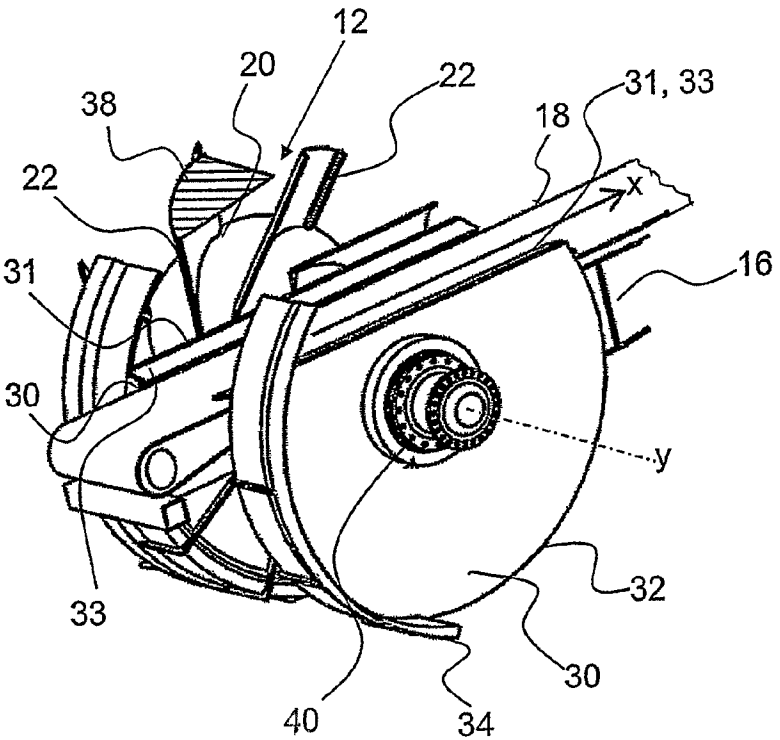
FIG. 2 schematically shows an oblique view of a detail of FIG. 1 with the right impeller wheel removed.
Figure 5:
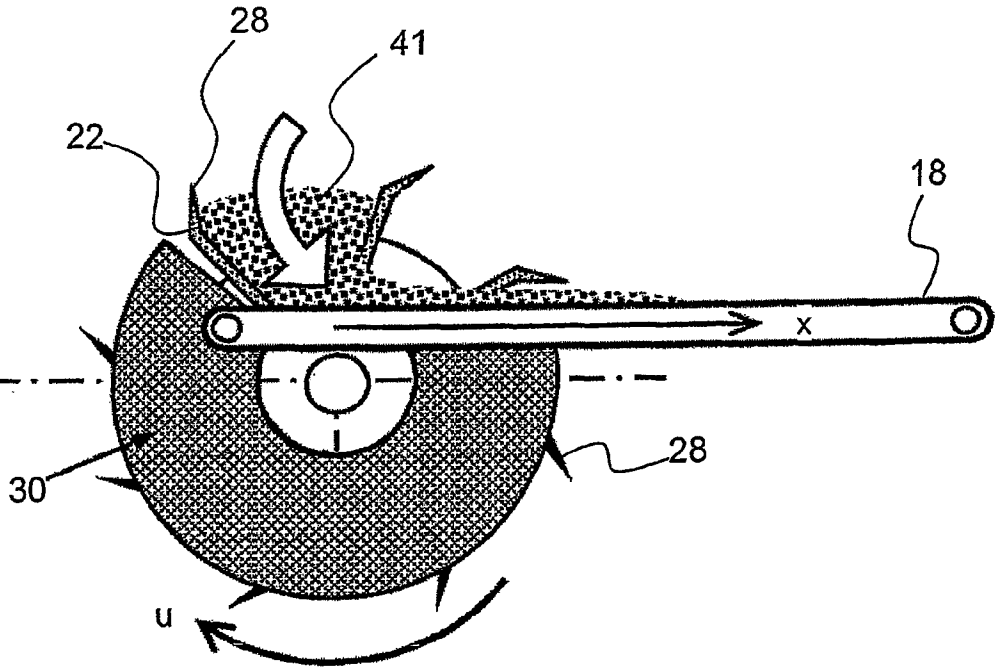
FIG. 5 schematically shows the side view of the arrangement of FIG. 4.
Figure 4:
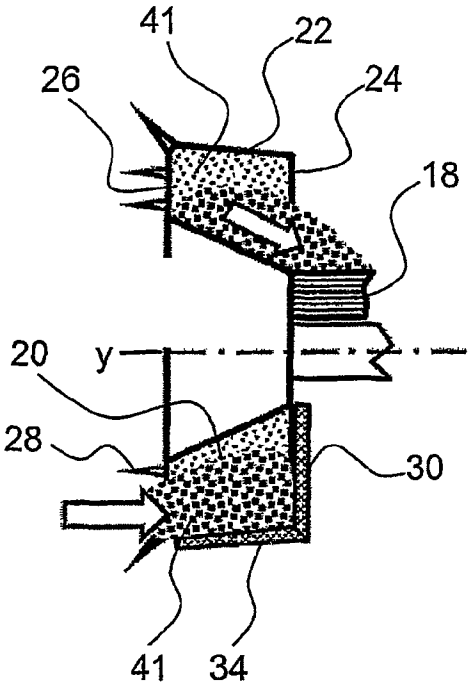
FIG. 4 schematically shows the further-simplified vertical section of FIG. 3 through the axis of rotation of part of the excavation apparatus of FIG. 1 as viewed counter to the conveying direction.

As shown in FIG. 2, the guide vanes 22 can be provided at their free radial end with a vane part 38 which projects substantially at a right angle with respect to the radial direction of the guide vanes 22 in the running direction u of the impeller wheel 12, 14, said guide vanes thereby being closed. When the guide vanes 22 are designed with a terminally projecting vane part 38, it is possible to dispense with the vane covering 34.

Each impeller wheel 12, 14 is equipped with a motor 40 for producing the rotational movement about the axis of rotation y. The two motors 40 can be controlled independently of one another.

In the case of a particular layer structure of a soil material 41 with, for example, a subsoil of clay 42 and an overlying layer of gravel 44, it is possible, as can be seen from FIGS. 6-11, for the filling of the guide vanes 22 to be adapted to the layer structure of the material to be excavated by changing the direction of rotation u of the impeller wheels 12, 14 while at the same time exchanging the two impeller wheels 12, 14.

With the direction of rotation represented, there is a risk, as shown in FIGS. 6-8, that the viscous clay 42 will flow out only in a delayed manner. The emptying time, or the time during which the guide vane 22 moves past the open guide plate 30, is therefore not sufficient for the clay 42 to flow out completely. The residual clay layer adhering to the guide vanes 22 becomes increasingly thicker, decreases the filling volume and reduces excavation efficiency.

In the arrangement shown in FIGS. 9-11 in which the direction of rotation is reversed, the heavy, loose gravel stones 44 promote the flow of the clay 42 and additionally have a cleaning effect on the impeller wheels 12, 14. The direction of rotation u in the counterclockwise direction is thus advisable in such conditions.

The guide channel formed by the vane covering 34 frees the guide vanes 22 above the conveyor belt 18, which has the following advantages:

- Bulky material, such as wood, ropes, cables, etc., which has been caught in the guide vanes 22 can be removed without problems after stopping the impeller wheel 12, 14.
- The guide vanes 22 can be cleaned automatically with the impeller wheel 12, 14 running or manually with the impeller wheel 12, 14 at a standstill, for example to remove stubbornly adhesive material such as clay, marl, etc.

By virtue of its continuous rotational movement, the impeller wheel 12, 14 is a highly efficient conveying device for mixed material to be excavated, such as sand, gravel, stones, etc., for example.

Since there are no permanent closed cavities, such as, for example, buckets with bases, this excavation system is also highly suited to problematic material to be excavated, such as wet humus, clay, marl, etc.

The impeller wheel 12, 14 is extremely compact and without exposed, movable parts, such as chains, buckets, etc., for example. Consequently, it can be provided with a robust design such that relatively large lumps which occur, such as masonry, stones, etc., are comminuted without problems. Should an object block the impeller wheel 12, 14, an automatic pressure cut-off protects the device from deformations. If it is found that, for example, a cable is trapped and wound up, the rotational movement can be stopped immediately and the entanglement removed by changing the direction of rotation. The two impeller wheels 12, 14 are driven individually via a respective motor 40 and can also be controlled individually.

The vane teeth 28 mounted at the outer lateral edge 26 of the guide vanes 22 serve to loosen hard material 41 to be excavated.

There are various optimization variants available to the impeller wheel 12, 14 depending on the particular area of application:

- When changing the direction of rotation u, the operating direction A can be changed (rearward, pivoting). Adaptation to layer structures of the material to be excavated is likewise possible.
- Upwardly closed-off guide vanes 22 having an angled vane part 38 instead of the vane covering 34 are particularly suitable for granular material to be excavated which does not contain bulky material such as wood, for example.

Figure 12:
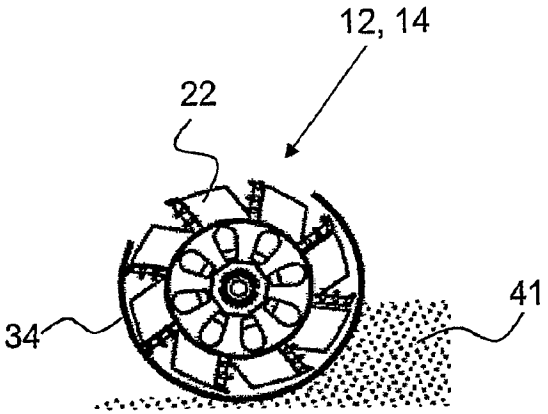

A vane covering 34 which is continuous in the excavation region (FIG. 12) is particularly suitable for problematic material to be excavated, such as large stones and wood. Bulky material is separated out. This arrangement functions for a pivoting operation, but not in the case of forward and rearward travel.

Figure 13:
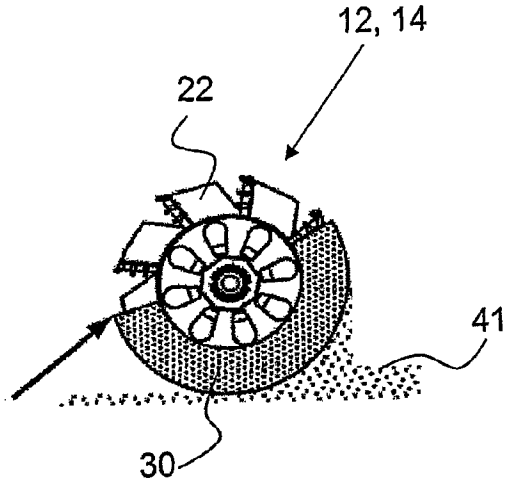
FIGS. 12-14 schematically show various impeller wheel embodiments.

A guide plate 30 which is continuous in the excavation region (FIG. 13) is particularly suitable for bulky material which cannot be comminuted, such as granite blocks and reinforced foundation remains, for example.

Figure 14:
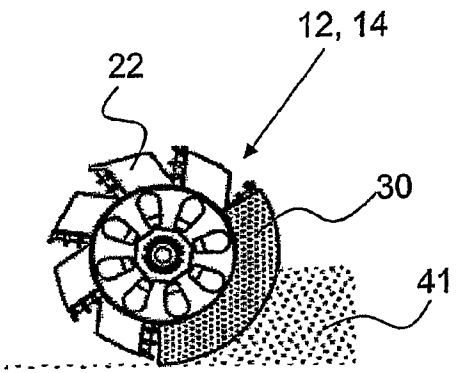

A shortened guide plate 30 (FIG. 14) is particularly suitable for bulky material which can be comminuted, such as bricks, for example.

LIST OF REFERENCE SIGNS

10 excavation machine
12 first impeller wheel
14 second impeller wheel
16 machine frame
18 conveyor belt
20 conical guide surface
22 guide vane
24 inner lateral edge of 22
26 outer lateral edge of 22
28 vane teeth
30 guide plate
31 upper edge of 30
32 peripheral edge of 30
33 cover plate
34 vane covering
36 chamber
38 vane part
40 motor
41 excavated material/material to be excavated
42 clay
44 gravel
A operating direction of 10
x conveying direction of 18
y axis of rotation of 12, 14
u direction of rotation of 12, 14
e distance between 18 and 31
S lower point of 34
T upper point of 34

The invention claimed is:

1. An apparatus for excavating and transporting away soil material, comprising:

two impeller wheels (12, 14) which can be rotated about an axis of rotation (y) in a direction of rotation (u), with a conically extending guide surface (20) arranged about the axis of rotation (y) in a rotationally symmetrical manner and with guide vanes (22) which project radially from the conically extended guide surface (20) and which form an acute angle with respect to the axis of rotation (y), and a conveyor belt (18) for transporting away excavated material (41), said conveyor belt being arranged between the impeller wheels (12, 14), said conveyor belt (18) having a conveying direction (x) which is at a right angle with respect to the axis of rotation (y), wherein, the conically extending guide surface (20) of the impeller wheels (12, 14) having a narrowed end adjoining the conveyor belt (18) and forming a run-off surface for the excavated material (41), wherein, the guide vanes (22) are bounded by two lateral edges (24, 26) which are parallel to one another, and the width of the guide vanes (22) corresponds substantially to the width of the conically extending guide surface (20), and wherein an inner lateral edge (24) of the guide vanes (22) adjoins a fixed guide plate (30) at least in a region below the conveyor belt (18).

2. The apparatus as claimed in claim 1, characterized in that the guide vanes (22) are twisted with respect to the axis of rotation (y) by an angle such that, as viewed in the direction of rotation (u), an outer lateral edge (26) leads the inner lateral edge (24).

3. The apparatus as claimed in claim 1, characterized in that the guide plate (30) terminates at a distance (e) above the conveyor belt (18) by way of an upper edge (31) situated parallel to a conveying plane of the conveyor belt (18), and a strip-like cover plate (33) extends from the upper edge (31) to the lower-lying conveyor belt (18).

4. The apparatus as claimed in claim 1, characterized in that a vane covering (34), which covers the guide vanes (22), projects inwardly from a peripheral edge (32) of the guide plate (30).

5. The apparatus as claimed in claim 1, characterized in that the guide vanes (22) are curved with respect to a cross section situated perpendicularly to the lateral edges (24, 26), and a curved surface of the guide vanes (22) points with a concave curvature in the direction of rotation (u) of the impeller wheels (12, 14).

6. The apparatus as claimed in claim 1, characterized in that the guide vanes (22) are provided at a free radial end with a vane part (38) which projects substantially at a right angle with respect to a radial direction of the guide vanes (22) in the direction of rotation (u) of the impeller wheel (12, 14).

7. The apparatus as claimed in claim 1, characterized in that vane teeth (28) project laterally outwardly from the guide vanes (22).

8. The apparatus as claimed in claim 1, characterized in that the impeller wheels (12, 14) are each assigned an individually controllable motor (40).

* * * * *